US008136670B2

(12) United States Patent
Garland

(10) Patent No.: US 8,136,670 B2
(45) Date of Patent: Mar. 20, 2012

(54) COLLAPSIBLE MOBILE MATERIAL PROCESSING PLANT WITH FLEXIBLE HOPPER

(75) Inventor: Dan L. Garland, Iowa City, IA (US)

(73) Assignee: Terex USA, LLC, Wilmington, DE (US)

( * ) Notice: Subject to any disclaimer, the term of this patent is extended or adjusted under 35 U.S.C. 154(b) by 0 days.

(21) Appl. No.: 13/021,492

(22) Filed: Feb. 4, 2011

(65) Prior Publication Data

US 2011/0192769 A1 Aug. 11, 2011

Related U.S. Application Data

(60) Provisional application No. 61/302,371, filed on Feb. 8, 2010.

(51) Int. Cl.
*B07B 1/28* (2006.01)

(52) U.S. Cl. ..... 209/240; 209/365.2; 209/260; 209/235; 209/242

(58) Field of Classification Search ..... 209/235, 209/240, 242, 260, 362.2, 412, 414
See application file for complete search history.

(56) References Cited

U.S. PATENT DOCUMENTS

| | | | | |
|---|---|---|---|---|
| 3,317,085 | A * | 5/1967 | Higgs | 222/58 |
| 3,510,073 | A * | 5/1970 | Mailliard | 241/81 |
| 3,656,696 | A * | 4/1972 | Mailliard | 241/155 |
| 3,909,401 | A * | 9/1975 | Thompson | 209/412 |
| 2008/0041984 | A1 * | 2/2008 | Sauser et al. | 241/75 |

* cited by examiner

*Primary Examiner* — Terrell Matthews
(74) *Attorney, Agent, or Firm* — Simmons Perrine Moyer Bergman PLC

(57) ABSTRACT

A mobile collapsible screen and cone crusher combination where the screen is pivoted forward and downward for transport and a rubber hopper is coupled to the fines conveyor so as to permit a hinged connection and a sliding connection between the flexible hopper and the fines conveyor. A plurality of flexible matter edge plates are used at the rear of the flexible hopper to facilitate proper compression and expansion of the flexible hopper. A selectable maintenance catch is used to allow the screen to be elevated to an intermediate height for maintenance.

15 Claims, 7 Drawing Sheets

COLLAPSIBLE MOBILE MATERIAL PROCESSING PLANT WITH FLEXIBLE HOPPER

BACKGROUND OF THE INVENTION

This invention relates to mobile rock crushing and screening plants. A portable rock crushing and screening processing plant is usually a collection of several units, each performing various material processing functions to prepare aggregate materials for use for, but not limited to, concrete and asphalt products. The various units can perform various stages of crushing, screening, conveying, and washing of aggregate and recycle materials. Portability is achieved by positioning the plants on towable or haulable modules, so that the plant can service multiple locations where processed materials can be produced.

Many plants have utilized a high vertical extent when fully deployed and it is often necessary to provide the ability to collapse the system, so as to meet highway height restrictions.

It has been know in the art to provide a folding and pivoting vibrating screen plant on a mobile platform. This has been done where the fines conveyor is directly coupled to the pivoting screen and moved forward along with the pivoting screen when the system is collapsed for transport. Other systems have utilized a fines conveyor fixed to the mobile frame and a rubber hopper disposed between the vibrating screen plant and the fines conveyor.

While both of these systems have enjoyed some commercial success in the industry, they both have drawbacks.

The system with the combined folding screen and fines conveyor can cause problems when the necessarily protruding fines conveyor is folded forward, thereby encroaching into space which is often needed for transferring material off the mobile platform. Additionally, the attached fines conveyor generally leads to use of a more expensive wider conveyor.

In the rubber hopper approach of the prior art, some of the screens were either lifted vertically without any forward pivoting and have resulted in limited height reduction or the need to partially disassemble inter-plant connections or the rubber was fixed at the bottom and pivoted, but resulting in leakage of fines material and the need for extra human involvement in the collapsing and raising process, to be certain that the hopper folds and unfolds optimally.

Consequently, there is a need for improvement in collapsible material processing equipment which eliminates leakage and extra labor without sacrificing space in front of the screen when folded forward, for the placement of transfer equipment.

SUMMARY OF THE INVENTION

More specifically, an object of the invention is to provide an efficient combination of mobile rock crushing and screen plants.

It is a feature of the present invention to include a rubber hopper on a pivot material processing machine which is hingedly coupled to a conveyor.

It is another feature of the present invention to include a rubber hopper to conveyor connection which is able to translate in a fixed plane along the longitudinal direction of the fines conveyor.

It is an advantage of the present invention to increase the differential in operating height to transport height without substantially adversely affecting the efficiency of the system.

It is another feature of the present invention to provide a flexible hopper rear end flexible matter sheet with a plurality of adjacent flexible matter edge plates.

It is an advantage of the present invention to allow for collapsing of the system without a need for human intervention during the collapsing process to assure the rubber hopper collapses in a preferred manner.

It is yet another feature of the present invention to include a selectable maintenance position, selectable stop catch configured to permit selectively allowing an intermediate elevated position for maintenance purposes.

The present invention includes the above-described features and achieves the aforementioned objects and advantages.

Accordingly, the present invention comprises a pivoting collapsible material processing unit with a rubber hopper secured thereto, which is hingedly and slideably coupled to a conveyor disposed beneath the material processing unit. More particularly, the present invention comprises:

A mobile material processing plant comprising:

a mobile frame support;

a vibrating screen plant for separating material;

a pivoting screen support leg, coupled to said mobile frame support and said vibrating screen plant, so that said vibrating screen plant can be simultaneously lowered and moved forward with respect to said mobile frame support;

a fines conveyor coupled to said mobile frame support, for transporting material;

a flexible hopper disposed between said vibrating screen plant and said fines conveyor; and said flexible hopper detachably coupled to said fines conveyor, such that a bottom edge of said flexible hopper is guided downward and inward toward a center line of said fines conveyor by a hinge connection which is configured free to translate forward along a longitudinal axis of said fines conveyor and pivot about an edge of said fines conveyor; when said vibrating screen plant is lowered and moved forward for transportation.

BRIEF DESCRIPTION OF THE DRAWINGS

In the following description of the drawings, like reference numerals are employed to indicate like parts, in the various views.

DETAILED DESCRIPTION OF THE DRAWINGS

Figure 1:
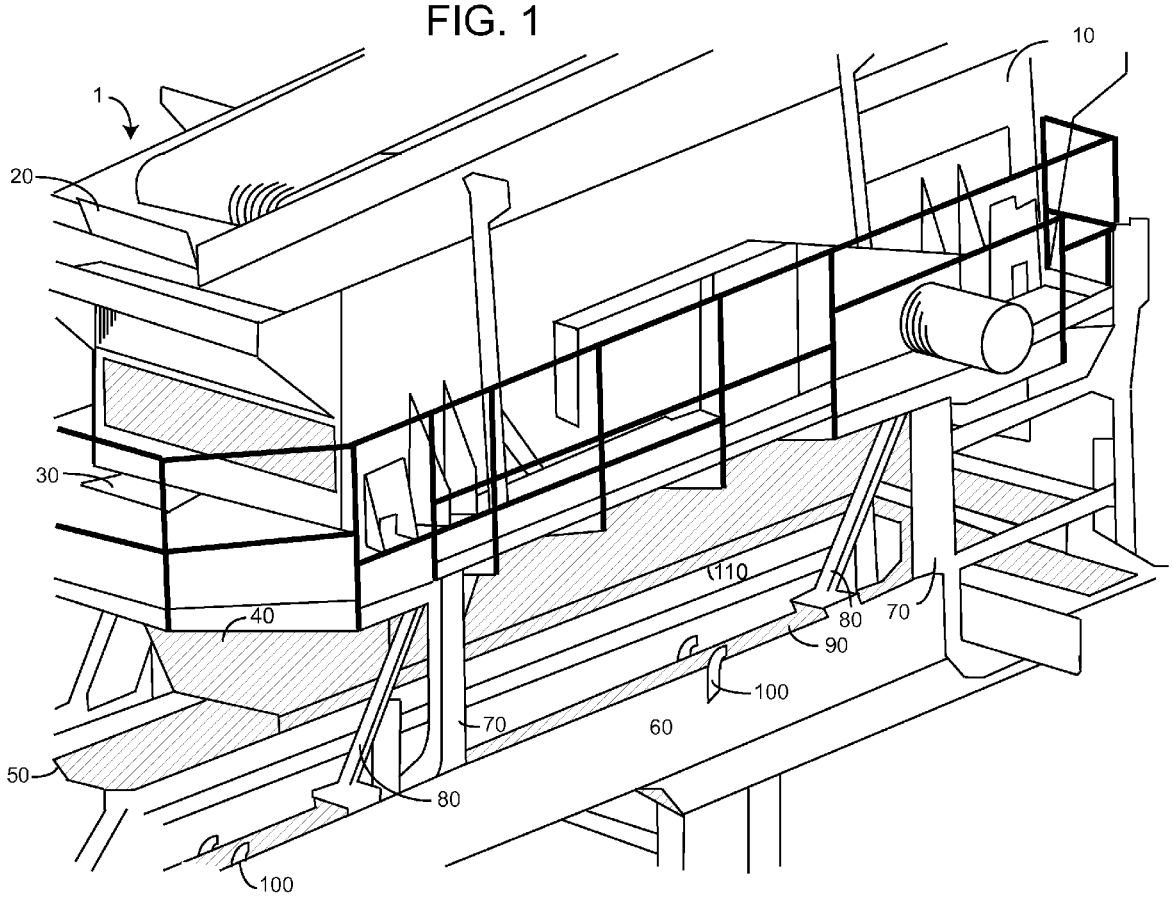
FIG. 1 is a perspective view of a portion of the system of the present invention.

Now referring to the drawings where like numerals refer to like matter throughout, and more specifically to FIG. 1, there is shown a portion of a pivoting mobile screen system, generally designated 1, of the present invention. A vibrating screen plant 10 is shown having vibrating screen plant material input section 20 and a vibrating screen plant bottom side 30 all disposed on a platform which is configured to be deployed by being raised for operation and being collapsed to accommodate height restrictions of highway travel.

Disposed below vibrating screen plant 10 and positioned to capture the fines material exiting from vibrating screen plant bottom side 30 is flexible hopper 40. Flexible hopper 40 is preferably made of a material, which is flexible and can be collapsed, under the weight of the vibrating screen plant 10 and later resume its earlier shape once the weight of the vibrating screen plant 10 on the flexible hopper 40 is reduced. Rubber sheeting and any other suitable material can be used for the sides of flexible hopper 40.

In one embodiment, the top of flexible hopper 40 is secured to the vibrating screen plant bottom side 30 with bolts or other suitable fasteners. The bottom side of flexible hopper 40 is disposed above but not fixedly secured to the fines conveyor 50 which is secured to the mobile frame support 60.

Vibrating screen plant 10 is supported in an elevated (deployed) configuration by pivoting screen support legs 70, which are configured to pivot at the base near the mobile frame support 60, so as to lower the vibrating screen plant 10 for transport while simultaneously moving the vibrating screen plant 10 forward, thereby allowing other structure (not shown) to move from a position above a cone crusher (not shown) which accepts as input some of the largest diameter material separated by vibrating screen plant 10. Fines conveyor 50 remains stationary with respect to the mobile frame support 60 as the vibrating screen plant 10 is pivoted downward and forward for transport.

Vibrating screen plant 10 is stabilized in its operation configuration (shown here in FIG. 1) by sliding and pivoting brace members 80, which rest upon mobile frame support top rail 90. Sliding and pivoting brace members 80 are configured to slide or roll along mobile frame support top rail 90 during the transition between transport and operational configuration. Additionally, vibrating screen plant 10 may be temporarily configured to an intermediate maintenance position between transport and operational configurations. The vibrating screen plant 10 is held in this configuration by maintenance position brace catch 100, which captures the sliding and pivoting brace members 80 as it moves along mobile frame support top rail 90.

However, during operation of the vibrating screen plant 10, it is desirable to achieve positive containment of the fines exiting the vibrating screen plant bottom side 30 and direct it all onto fines conveyor 50 where it can be moved away from the vibrating screen plant 10 and stockpiled or provided to still other material processing equipment for various purposes. Fines conveyor top side 110 remains stationary while flexible hopper 40 moves forward.

Figure 2:
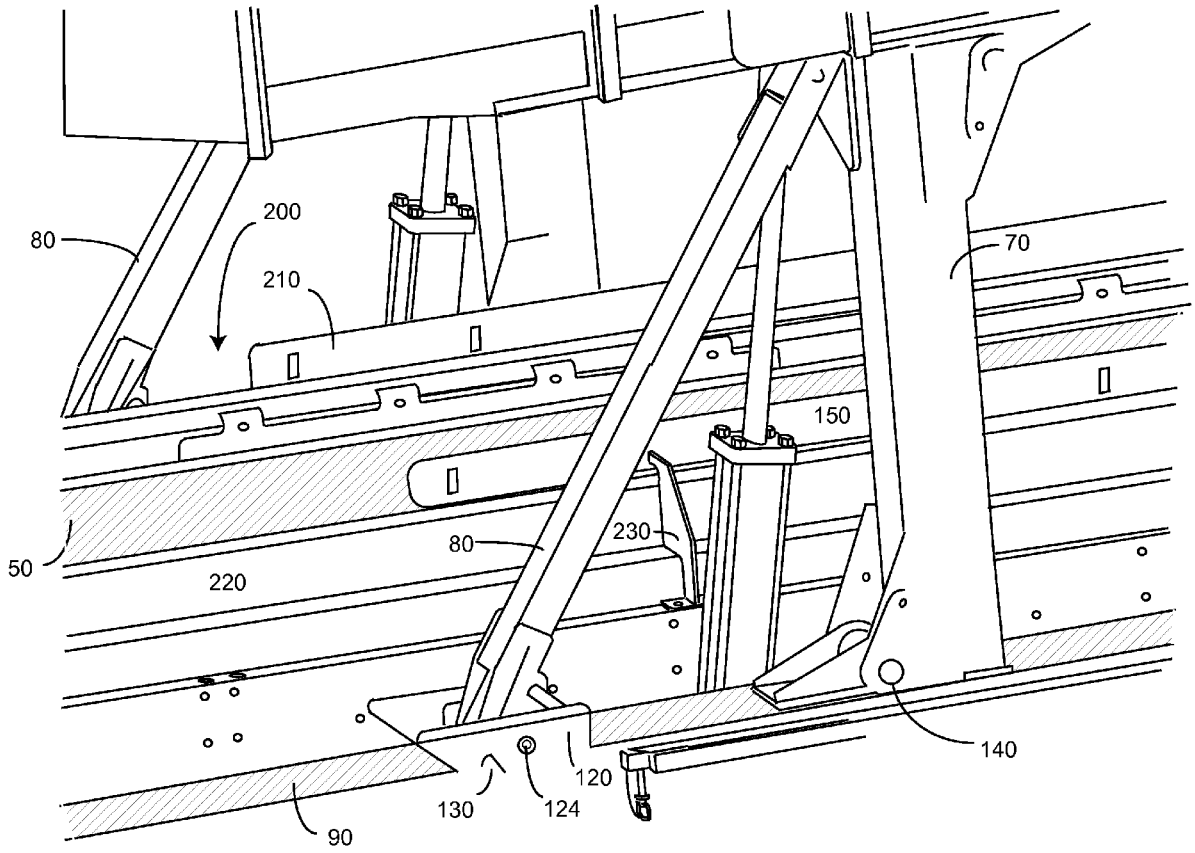
FIG. 2 is a close up perspective view of a portion of FIG. 1 with the flexible hopper having been removed for illustrative purposes only.

Now referring to FIG. 2, there is shown close up view of a portion of the system 1 of FIG. 1, where the flexible hopper 40 has been removed for illustration purposes only. There is shown a conveyor to flexible panel mating hinge 200 disposed on each side of the fines conveyor 50. Conveyor to flexible panel mating hinge 200 is made up of a flexible panel attachment hinge plate 210 and a conveyor structure fixed hinge plate 220. Flexible panel attachment hinge plate 210 is configured to be coupled to the flexible hopper 40 and rotate inward and downward toward fines conveyor 50, when the weight of vibrating screen plant 10 is allowed to push upon the top of and collapse the flexible hopper 40. The conveyor to flexible panel mating hinge 200 helps control the direction of movement of the flexible hopper 40 sides during the collapsing process. Flexible panel attachment hinge plate 210 is prevented from rotating away from fines conveyor 50 by hinge pivoting range limiter 230, which is fixed to the exterior of fines conveyor 50 and ultimately to mobile frame support 60. The collapsing process is facilitated by pivoting screen support legs 70 about pivoting screen support leg primary pivot pin 140 with the aid of hydraulic cylinder 150, which is coupled at one end to mobile frame support 60 and at the other end to vibrating screen plant 10.

Sliding and pivoting brace members 80 is shown having a brace terminal rail contacting pin 130 disposed at its lower terminal portion and shown here disposed in a recess in automatic deployed position brace pivoting catch 120, which is configured to pivot about deployed position automatic stop catch pivot pin 124 when sliding and pivoting brace members 80 moves along mobile frame support top rail 90 during configuration transitions.

Figure 3:
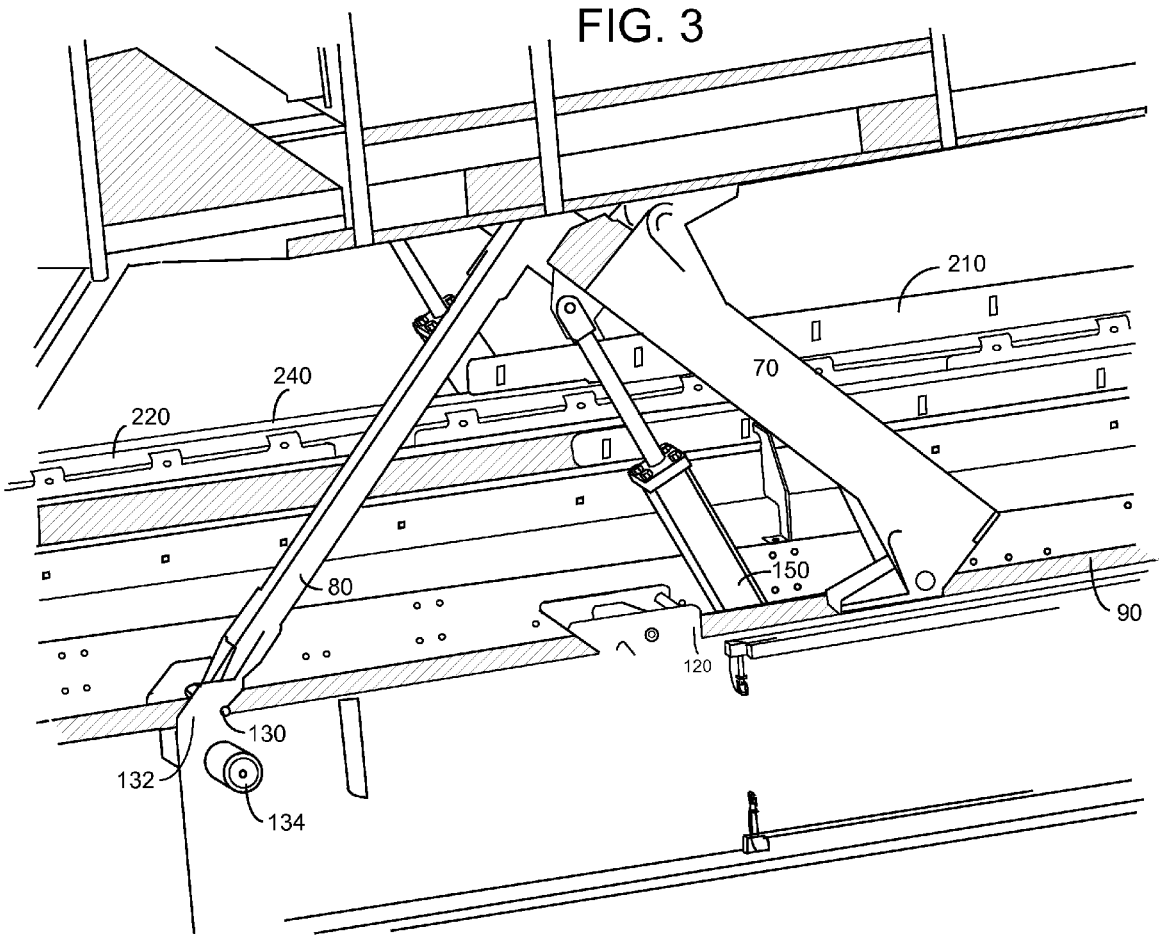
FIG. 3 is a close up perspective view of the system of FIG. 2 with the vibrating screen plant being disposed in an intermediate maintenance configuration.

Now referring to FIG. 3, there is shown the system of FIG. 2, but with the vibrating screen plant 10 being disposed in the intermediate maintenance configuration. Here it can be seen that sliding and pivoting brace members 80 has moved forward along mobile frame support top rail 90 and maintenance brace terminal rail contacting pin 130 now is disposed in a recess in maintenance position selectable stop catch 132. Maintenance position selectable stop catch 132 is configured to be pivoted around maintenance position selectable stop catch pivot pin 134 to its upright configuration, as shown here and the rotated downward and out of the way and therefore unable to retain brace terminal rail contacting pin 130 as it moves along mobile frame support top rail 90, to the fully collapsed configuration.

A closer inspection of FIG. 3 reveals that flexible panel attachment hinge plate 210 remains stationary and does not slide along hinge pin 240. This would be exactly the case if the flexible hopper 40 were physically removed from the system 1. In normal operation flexible hopper 40 is coupled to flexible panel attachment hinge plate 210, which would be forced to translate along hinge pin 240 during the collapsing process. The fact that the point of attachment between the flexible hopper 40 and the fines conveyor 50 is both hinged and able to translate, is believed to be novel and provides some of the key beneficial aspects of the present invention.

Figure 4:
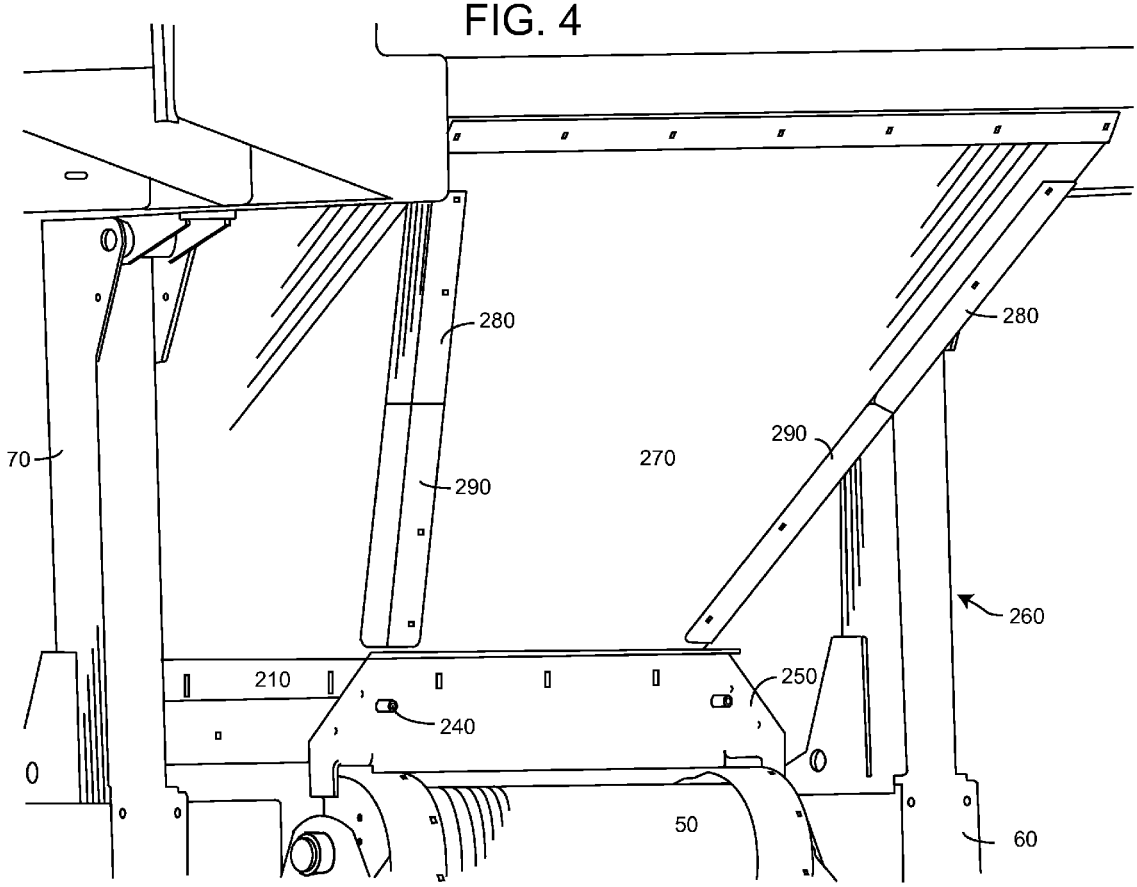
FIG. 4 is a perspective view of the flexible hopper rear end portion of FIG. 1.

Now referring to FIG. 4, there is shown a rear end of the system 1 of the present invention which shows the rear end of flexible hopper 40. End plate 250 forms the rear end of the structure which is disposed between flexible hopper 40 and fines conveyor 50. Hinge pin 240 is shown extending through end plate 250. Flexible hopper rear end flexible matter 270 makes up the sides of flexible hopper rear end portion 260. Flexible hopper rear end flexible matter 270 is preferably made of two adjacent separate pieces of flexible matter with a vertical boundary between them extending generally from end plate 250, at its horizontal midpoint up to a mid point at the top of the rear portion of flexible hopper 40 and at a midpoint of a rear portion of vibrating screen plant bottom side 30.

Coupled to an edge of flexible hopper rear end flexible matter 270 is top flexible matter edge plate 280 and bottom flexible matter edge plate 290, which are separate plates allowing bending to occur at the gap there between. Top flexible matter edge plate 280 may be bolted to flexible hopper rear end flexible matter 270 and may in at least one embodiment be adjacent to a longitudinal side panel of flexible hopper 40 but not be bolted thereto. Top flexible matter edge plate 280 and bottom flexible matter edge plate 290 help guide and control the location, direction and nature of the bending of flexible hopper 40 during the collapsing process and help to create a positive containment of fines material when the vibrating screen plant 10 is raised and the flexible hopper 40 is allowed to return to its un-collapsed state.

Figure 5:
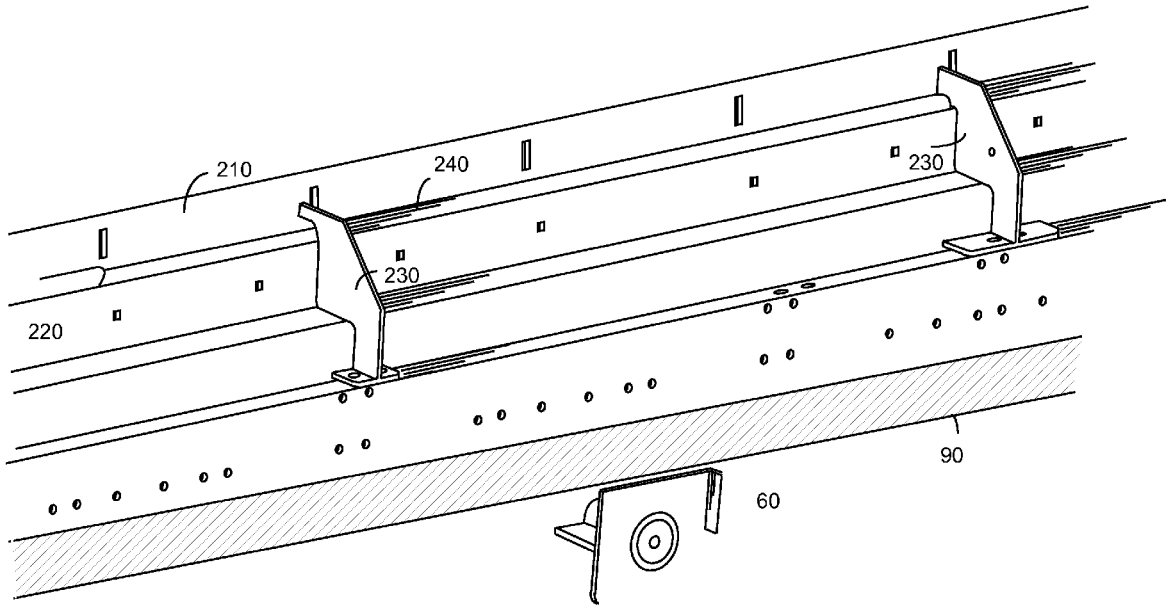
FIG. 5 is a close up view of a portion of FIG. 1.

Now referring to FIG. 5, there is shown a close up view of the system of FIG. 1 which shows the flexible hopper 40 coupled to flexible panel attachment hinge plate 210 which is shown coupled to hinge pin 240 so as to be able to translate along the length of hinge pin 240 during the collapsing or raising process.

Figure 6:
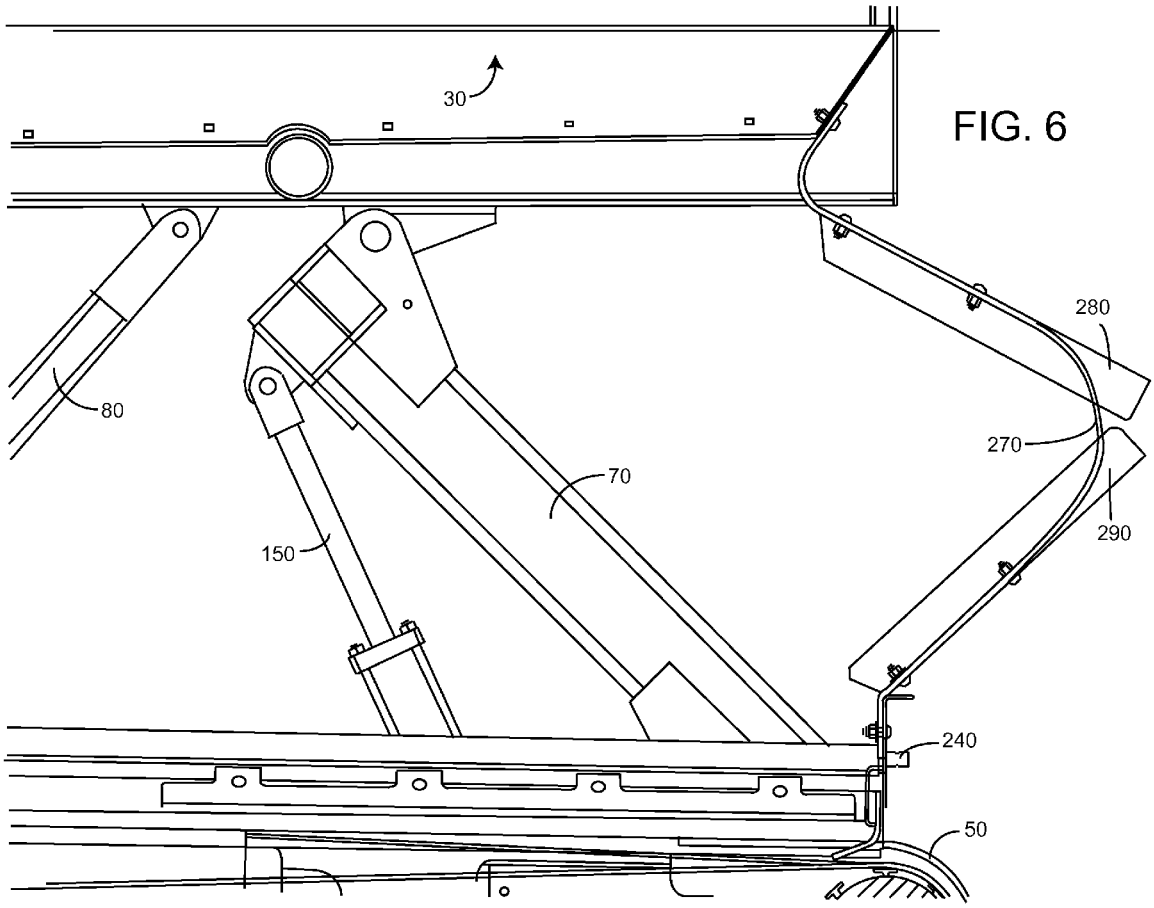
FIG. 6 is a close up side view of a rear portion of the system of FIG. 1 in a partially collapsed state.

Now referring to FIG. 6, there is shown top flexible matter edge plate 280 and bottom flexible matter edge plate 290 in a partially collapsed state.

Figure 7:
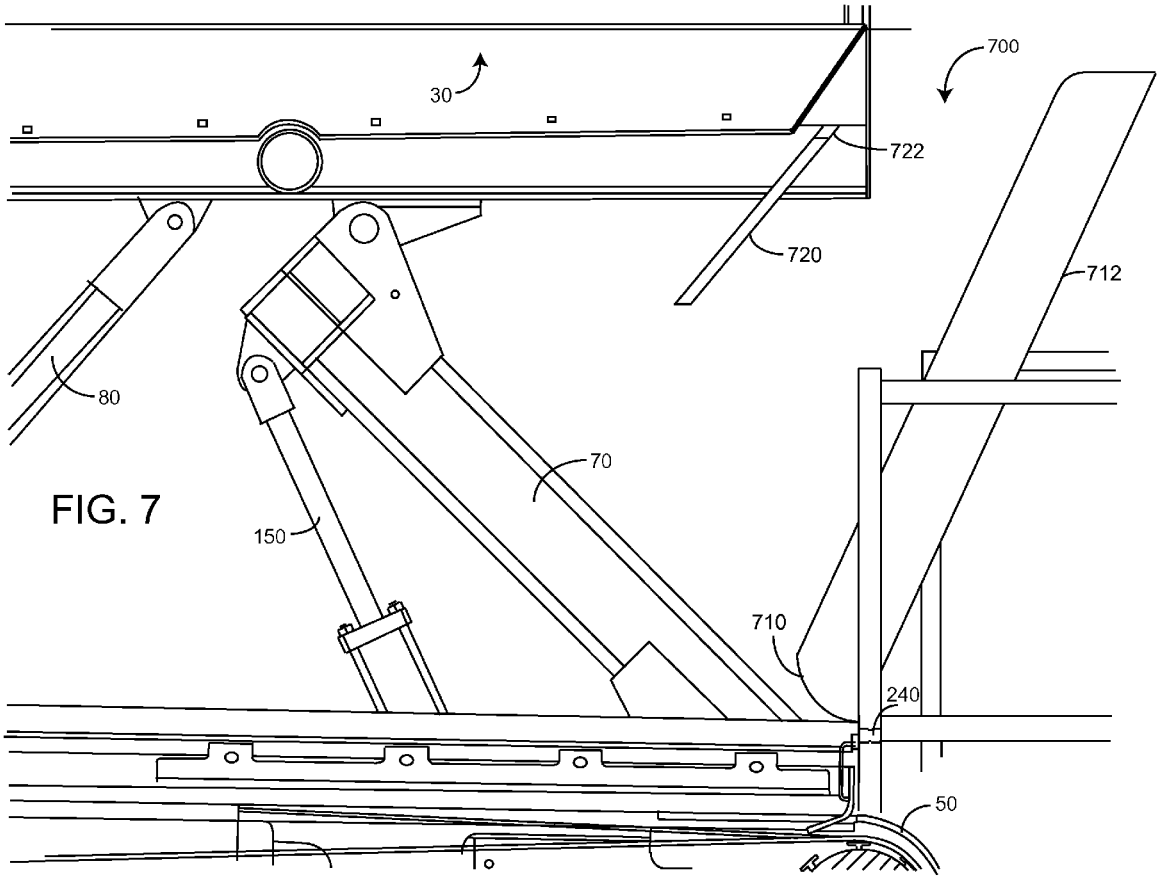
FIG. 7 is a close up side view of a rear portion of the system of FIG. 1 in a partially collapsed state, except that the hopper has an alternate rear end configuration.

Now referring to FIG. 7 there is shown a system of the present invention with an alternate rear end configuration. A stationary hopper rear end chute section 700 is shown with a bottom chute portion 710 and a top chute portion 712 each which remains stationary with respect to the fines conveyor 50 and its support structure. As the vibrating screen plant bottom side 30 pivots forward during the process of transforming to either a maintenance mode or a transport mode, the vibrating screen plant bottom side 30 moves away from the chute section 700 which is preferably a rigid, stationary chute like member which is made of steel or other suitable material. A hanging flexible hopper rear portion 720 is coupled to a support bracket 722 or other structure so as to allow a mating of the remainder of the hopper with the chute section 700 even if there is not perfect alignment therebetween. Hanging flexible hopper rear portion 720 overlaps with portions of the top section 712 of the chute section 700.

It is believed that when these teachings are combined with the known prior art by a person skilled in the art of mobile rock crushing and screening operations and equipment manufacture, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

I claim:

1. A mobile material processing plant comprising:

a mobile frame support;

a vibrating screen plant for separating material;

a pivoting screen support leg, coupled to said mobile frame support and said vibrating screen plant, so that said vibrating screen plant can be simultaneously lowered and moved forward with respect to said mobile frame support;

a fines conveyor coupled to said mobile frame support, for transporting material;

a flexible hopper disposed between said vibrating screen plant and said fines conveyor; and said flexible hopper detachably coupled to said fines conveyor, such that a bottom edge of said flexible hopper is guided downward and inward toward a center line of said fines conveyor by a hinge connection which is configured free to translate forward along a longitudinal axis of said fines conveyor and pivot about an edge of said fines conveyor; when said vibrating screen plant is lowered and moved forward for transportation.

2. The system of claim 1 further comprising:

a sliding and pivoting brace member configured to move along said mobile frame support top rail during transition between a collapsed transport configuration and elevated operational configuration.

3. The system of claim 2 further comprising:

a automatic deployed position brace pivoting catch, configured to automatically capture one of said plurality of sliding and pivoting brace members, when the vibrating screen plant is raised upward to an operational configuration.

4. The system of claim 3 further comprising:

a brace terminal rail contacting pin disposed on one of said plurality of sliding and pivoting brace members.

5. The system of claim 4 wherein said flexible hopper comprises at least 3 sides.

6. The system of claim 5 further comprising a stationary rear hopper chute which remains stationary with respect to said mobile frame support when one of said plurality of sliding and pivoting brace members is pivoted to transform said system from an operational mode to a transport or maintenance mode.

7. The system of claim 5 further comprising a flexible rear hopper portion comprising a flexible rear hopper panel with a plurality of rigid guide members coupled to said flexible rear hopper panel so that when one of plurality of sliding and pivoting brace members is pivoted said flexible rear hopper panel is permitted to flex in only one direction so that an exterior of said flexible rear hopper panel is in a convex orientation and extending in a direction opposite of a direction of motion of said flexible hopper along the longitudinal axis of said fines conveyor.

8. The system of claim 7 further comprising a hinge pivoting range limiter disposed on a side of said fines conveyor.

9. The system of claim 8 further comprising:

a plurality of pivoting screen support legs, which includes said pivoting support leg, coupled to said mobile frame support and said vibrating screen plant, so that said vibrating screen plant can be simultaneously lowered and moved forward with respect to said mobile frame support.

10. A mobile material processing plant comprising:

a mobile frame support;

a vibrating screen plant for separating material;

a pivoting screen support leg, coupled to said mobile frame support and said vibrating screen plant, so that said vibrating screen plant can be simultaneously lowered and moved forward with respect to said mobile frame support;

a fines conveyor coupled to said mobile frame support, for transporting material;

a flexible hopper, having at least three sides, disposed between said vibrating screen plant and said fines conveyor;

said mobile frame support having a mobile frame support top rail;

a stationary hopper rear portion coupled to and stationary with respect to said mobile frame support;

a sliding and pivoting brace member configured to move along said mobile frame support top rail during transition between a collapsed transport configuration and elevated operational configuration;

a automatic deployed position brace pivoting catch, configured to automatically capture one of said plurality of sliding and pivoting brace members, when the vibrating screen plant is raised upward to an operational configuration;

a brace terminal rail contacting pin disposed on one of said plurality of sliding and pivoting brace members;

wherein said means for funneling comprises a hopper with rubber panel portions.

11. The system of claim 10 wherein said powered means is a fines conveyor.

12. The system of claim 10 wherein said vibrating means comprises vibrating screen plant.

13. The system of claim 1 wherein said flexible hopper comprises at least 3 sides.

14. The system of claim 1 further comprising a hinge pivoting range limiter disposed on a side of said fines conveyor.

15. The system of claim 1 further comprising:

a plurality of pivoting screen support legs, which includes said pivoting support leg, coupled to said mobile frame support and said vibrating screen plant, so that said vibrating screen plant can be simultaneously lowered and moved forward with respect to said mobile frame support.

* * * * *